US006256465B1

(12) United States Patent
Yoshinaga et al.

(10) Patent No.: US 6,256,465 B1
(45) Date of Patent: Jul. 3, 2001

(54) IMAGE FORMING APPARATUS AND IMAGE FORMING UNIT THEREFOR

(75) Inventors: Hiroshi Yoshinaga, Chiba; Takeo Suda; Moriaki Ogawa, both of Tokyo, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/420,522

(22) Filed: Oct. 18, 1999

(30) Foreign Application Priority Data

Oct. 16, 1998 (JP) ..... 10-294348
Dec. 9, 1998 (JP) ..... 10-349525

(51) Int. Cl.[7] ..... G03G 15/08
(52) U.S. Cl. ..... 399/103; 399/268; 399/271
(58) Field of Search ..... 399/98, 99, 103, 399/105, 268, 271, 316, 388

(56) References Cited

FOREIGN PATENT DOCUMENTS 5-040392 2/1993 (JP) .
9-222790 8/1997 (JP) .
11-174751 7/1999 (JP) .

*Primary Examiner*—William J. Royer
(74) *Attorney, Agent, or Firm*—Oblon, Spivak, McClelland, Maier & Neustadt, P.C.

(57) ABSTRACT

An image forming apparatus capable of obviating a defective image ascribable to image transfer and an image forming unit therefor are disclosed. A nonconductive sheet member is affixed to the surface of a conductive sheet member which will face a paper or similar recording medium, and protects the paper from the influence of a bias applied to the conductive sheet member. The paper is therefore free from a charge different in polarity from a transfer bias, so that toner is prevented from scattering toward the paper.

21 Claims, 3 Drawing Sheets

IMAGE FORMING APPARATUS AND IMAGE FORMING UNIT THEREFOR

BACKGROUND OF THE INVENTION

The present invention relates to an image forming apparatus capable of protecting a toner image from contamination and an image forming unit therefor.

A laser printer, facsimile apparatus, digital copier or similar electrophotographic image forming apparatus forms a latent image on a photoconductive element or image carrier, develops it to produce a toner image, and transfers the toner image to a paper or similar recording medium. At the time of image transfer, a bias opposite in polarity to the charge of toner forming the toner image is applied from the paper side in order to electrostatically deposit the toner on the paper.

However, the problem with the above bias scheme is that if the paper is charged by friction acting between it and conveying members, the transfer of the toner from the photoconductive element to the paper is promoted more than expected. As a result, the toner is apt to scatter and deposit on the background of the paper, lowering image quality.

Japanese Patent Laid-Open Publication No. 6-118803, for example, discloses an arrangement for preventing the toner from scattering during image transfer. The arrangement taught in this document includes a varistor or constant voltage element connected to ground and located upstream of an image transfer station in the direction in which a paper moves toward the image transfer station. The varistor may be replaced with a discharging member for applying a DC current opposite in polarity to a bias for image transfer. The discharging member discharges a paper when the paper is brought into contact therewith.

A developing device included in an image forming apparatus of the type described induces the scattering of toner toward a paper. In light of this, there has been proposed a conductive sheet member located downstream of a position where a photoconductive element and a developing roller included in the developing device face each other in the direction of movement of the element. A bias voltage of the same polarity as a bias voltage for development is applied to the conductive sheet member via a terminal member. The terminal member is implemented by a leaf spring and anchored at opposite ends thereof to the shaft of the developing roller and the conductive sheet member. In this configuration, the sheet member intercepts toner flying from the developing device toward an image transfer station adjoining the developing device. In addition, the bias voltage prevents such toner from depositing on the sheet member.

However, if a paper contacts the above conductive sheet member applied with the bias of the same polarity as the toner, the paper is charged by the sheet member. As a result, it is likely that the paper is unevenly charged or repulses the toner, resulting in irregular image transfer or toner scattering which would bring about a defective image.

Technologies relating to the present invention are also disclosed in, e.g., Japanese Patent Laid-Open Publication Nos. 5-40392, 9-222790 and 11-174751.

SUMMARY OF THE INVENTION

It is therefore an object of the present invention to provide an image forming apparatus capable of obviating a defective image ascribable to image transfer, and an image forming unit therefor.

It is another object of the present invention to provide an image forming apparatus capable of obviating irregular image transfer and toner scattering during image transfer, and an image forming unit therefor.

An image forming apparatus of the present invention includes a conductive sheet member facing a developing roller included in a developing device as toner feeding means, a bias applying device for applying a bias of the same polarity as a bias for development to the conductive sheet member, and a nonconductive sheet member affixed to the conductive sheet member in such a manner as to face a recording medium carrying a toner image formed by the developing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 2:
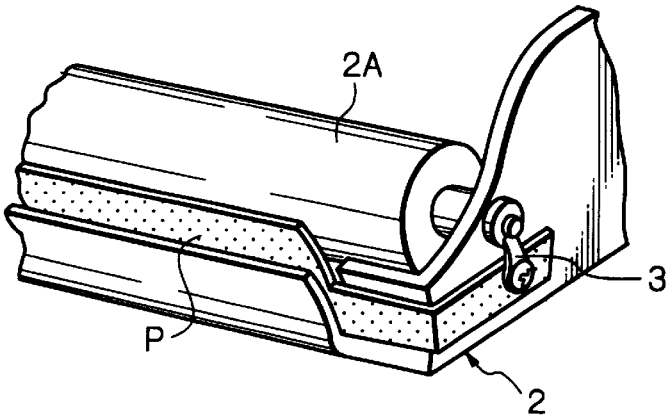
Fig. 2 PRIOR ART
FIG. 2 is a fragmentary perspective view of a developing device included in the conventional image forming apparatus.

To better understand the present invention, brief reference will be made to a conventional image forming apparatus, particularly an image forming unit thereof, including a measure against the scattering of toner toward a paper or similar recording medium. As shown, the image forming unit includes a photoconductive drum 1 rotatable in a direction indicated by an arrow. A developing device 2 includes a developing roller 2A. A conductive sheet member P is located downstream of a position where the drum 1 and developing roller 2A face each other in the direction of rotation of the drum 1. As shown in FIG. 2, a conductive terminal member 3 is implemented by a leaf spring and anchored at opposite ends thereof to the shaft of the developing roller 2A and the conductive sheet member P. A bias voltage of the same polarity as a bias voltage for development is applied to the sheet member P via the terminal member 3. In this configuration, the sheet member P intercepts toner flying from the developing device 2 toward an image transfer station adjoining the developing device 2. In addition, the bias voltage prevents such toner from depositing on the sheet member P.

A toner image formed by the developing device 2 is electrostatically transferred to a paper or similar recording medium at the image transfer station. At this instant, the above conventional image forming apparatus including the conductive sheet member P is apt to cause the toner to scatter for the following reason.

The sheet member P is so positioned as to prevent the toner from flying toward the image transfer station where the drum 1 face and contact a transfer roller T. The sheet member P therefore adjoins a path along which a paper S is conveyed to the image transfer station. It follows that if the paper S contacts the sheet member P applied with the bias of the same polarity as the toner, the paper S is charged by the sheet member P. It is therefore likely that the paper S is unevenly charged or repulses the toner, resulting in irregular image transfer or toner scattering which would bring about a defective image.

Figure 1:
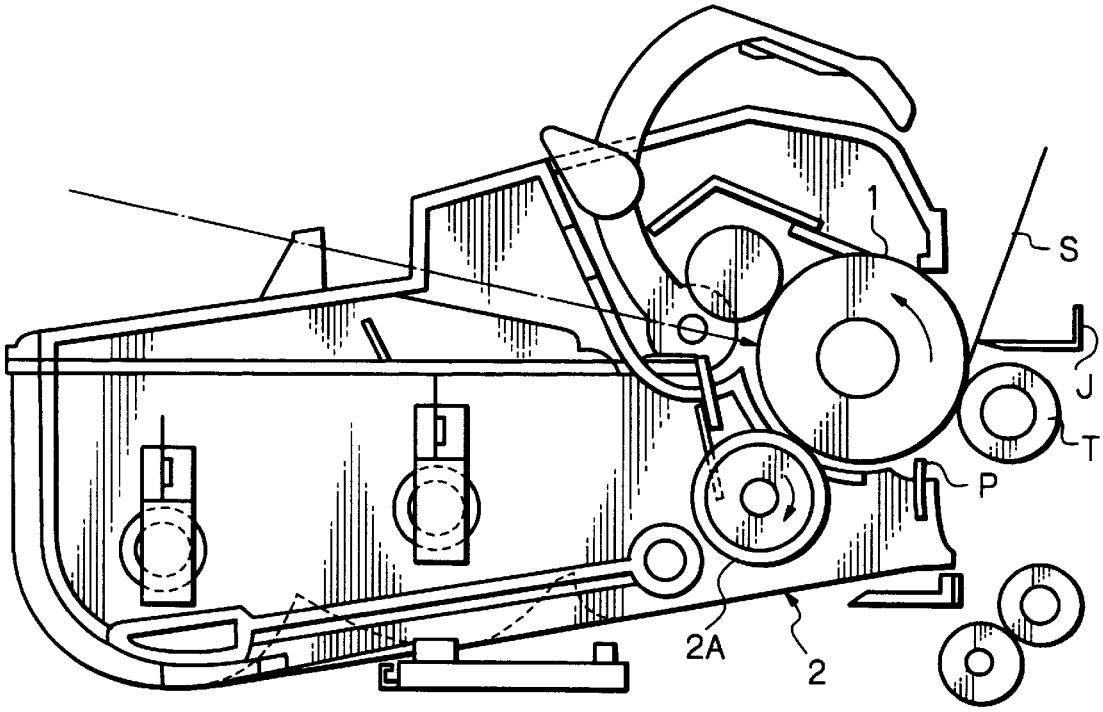
Fig. 1 PRIOR ART
FIG. 1 is a view showing a conventional image forming apparatus.

As for the bias for development, a DC component is sometimes biased by an AC component ranging from 500 V to 3,000 V. Such an AC biased DC voltage aggravates the above defective image. We conducted series of experiments under the following conditions for forming images on papers S with the image forming unit of FIG. 1. The drum 1 was charged to a potential of −750 V in a white portion and to a potential of -100 V in a black portion. The bias for development was implemented by an AC component of −1.8 kV, and a DC component of −600 V. A current of +12 $\mu$A was selected for image transfer. A current flowing through a discharge needle J (see FIG. 1) was measured to be −3 $\mu$A to +5 $\mu$A. Usually, so long as the paper S is not charged, only the positive current is expected to flow through the discharge needle J. However, the above result of measurement indicates that the bias for development effects even the paper S and makes the charge condition of the paper S unstable. The experiments showed that irregularity in density occurs on the paper S in the direction in which the paper S moves.

On the other hand, when use is made of the conductive sheet member P, it is likely that toner deposits on the sheet member P and is transferred from the sheet member P to the paper S. While the volume resistivity of the sheet member P effecting the deposition of toner is $10^6$ Ω.cm, it can obviate the deposition when lying in the range of from $10^1$ Ω.cm to $10^9$ Ω.cm. The voltage applied to the sheet member P, as stated earlier, prevents the toner from depositing on the sheet member P and thereby protects the paper S from contamination.

However, when the paper S contacts the sheet member P, there arises the previously discussed problem.

Figure 3:
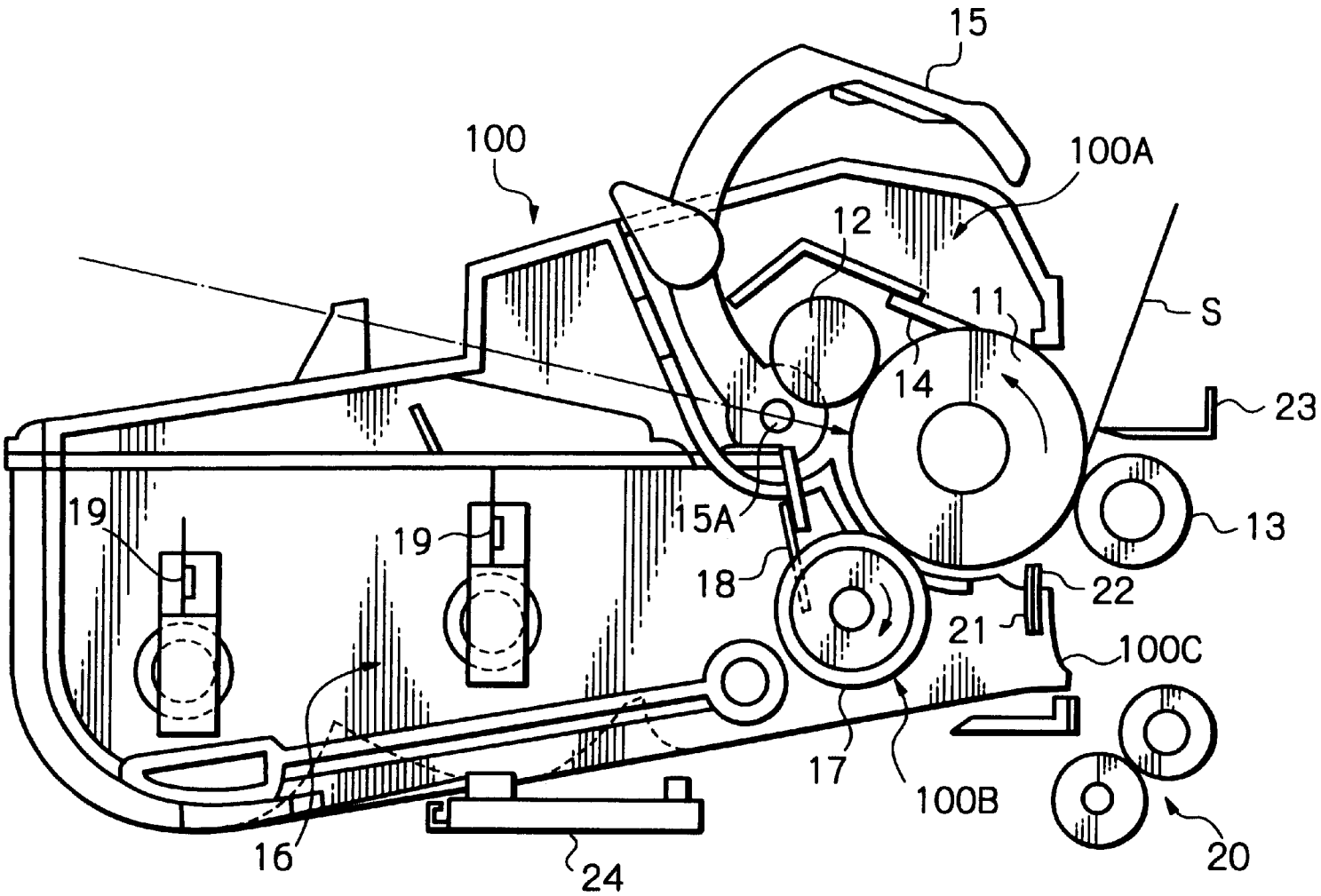
FIG. 3 is view showing an image forming apparatus embodying the present invention.

Referring to FIG. 3, an image forming apparatus, particularly an image forming unit thereof, embodying the present invention is shown and implemented as an electrophotographic copier, printer or facsimile apparatus. As shown, the apparatus includes an image forming unit 100 in the form of a partly open casing removably mounted to the body of the apparatus not shown. The image forming unit 100 is generally made up of a drum block 100A and a development block 100B. The drum block 100A includes a photoconductive drum 11 while the development block 1008 includes a developer chamber 16 storing a magnetic one-ingredient type developer (toner hereinafter) and a developing roller or toner feeding means 17.

In the drum block 100A, the drum 11 is rotated by drive transmitting means, not shown, in a direction indicated by an arrow in FIG. 3, while being partly exposed to the outside via the opening of the image forming unit 100. A charge roller 12, an optical path (dash-and-dot line) defined by writing optics, not shown, the developing roller 17, a transfer roller 13 and a cleaning blade 14 are arranged around the drum 11. A shutter member 15 selectively opens or closes the above opening of the image forming unit 100. Specifically, the shutter member 15 is supported by opposite side walls of the drum block 100A via a shaft 15A and rotatable about the shaft 15A for opening and closing the opening of the image forming unit 100. When the image forming unit 100 is dismounted from the apparatus body, the shutter member 15 automatically closes the opening in order to protect the drum 11 from damage.

The development block 100B has a space isolated from the drum block 100A by a partition, as illustrated. Part of the space forms the developer chamber 16 remote from the drum 11 and storing the toner or magnetic one-ingredient type developer. The developing roller 17 is disposed in the developer chamber 16 and faces the drum 11 in order to effect magnet brush development using the toner. A bias for development is applied to the developing roller 17 in the form of a DC component and an AC component superposed on each other. A developing blade 18 is held in contact with the developing roller 17 and charges the toner existing between the blade 18 and the roller 17 by friction.

Agitators 19 are arranged in the developer chamber 16 for conveying the toner toward the developing roller 17. A magnet, not shown, disposed in the developing roller 17 causes the frictionally charged toner to deposit on the surface of the roller 17 in the form of a magnet brush. The toner is transferred from the developing roller 17 to the drum 11 due to the electrostatic attraction of a latent image existing on the drum 11. As a result, the latent image is developed to turn out a toner image. The transfer roller 13 is held in contact with and rotated by the drum 11 while being applied with a bias for image transfer. When a registration roller pair 20 feeds a paper or similar recording medium S to the transfer roller 13 at a preselected timing, the transfer roller 13 electrostatically transfers the toner image from the drum 11 to the paper S.

Figure 4:
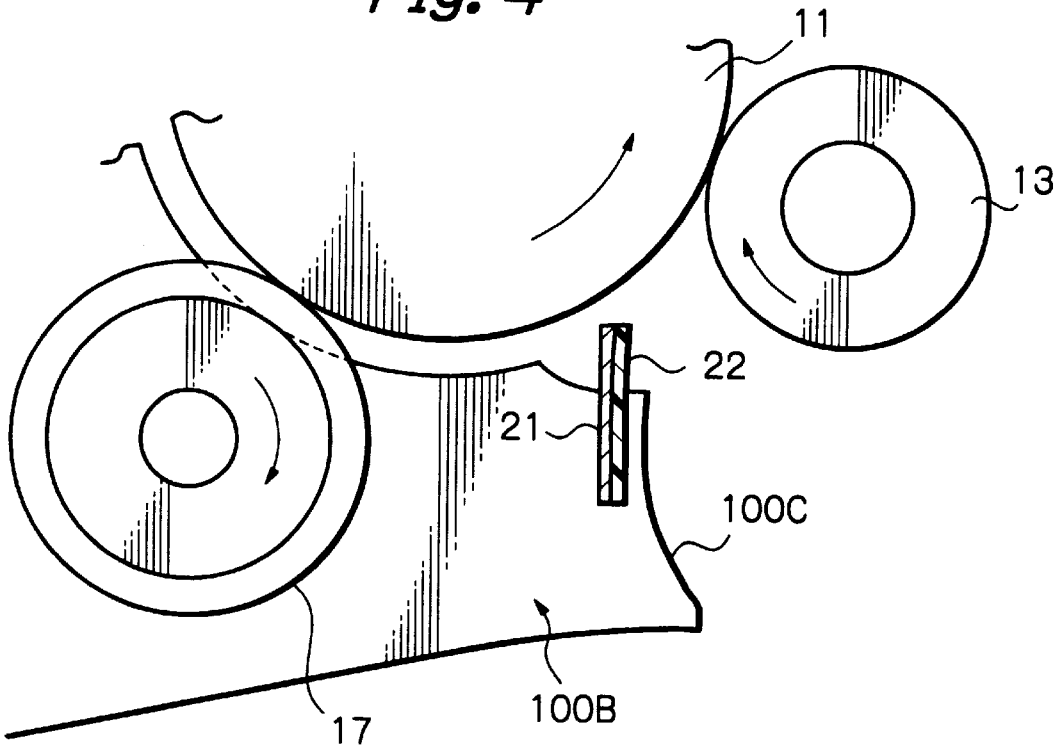
FIG. 4 is a fragmentary enlarged view showing a specific configuration of a conductive sheet member and a nonconductive sheet member included in the illustrative embodiment.

The image forming unit 100 includes a guide surface 100C adjoining the registration roller pair 20. The guide surface 100C guides the paper S toward the position where the drum 11 and transfer roller 13 contact each other. A conductive sheet member 21 and a nonconductive sheet member 22 are affixed to the image forming unit 100 in the vicinity of the guide surface 100C. FIG. 4 shows aspecific configuration of the two sheet members 21 and 22 in an enlarged scale.

The conductive sheet member 21 plays the same role as the conductive sheet member P shown in FIG. 2. The nonconductive sheet member 22 is formed of polyethylene terephthalate (PET) or similar insulating material and adhered or otherwise affixed to the conductive sheet member 21. Specifically, the nonconductive sheet member 22 is adhered to the surface of the conductive sheet member 21 which will face the paper S being conveyed by the registration roller pair 20 along the guide surface 100C. There are also shown in FIG. 3 a discharge needle 23 capable of contacting the paper S carrying the toner image thereon and a toner end sensor 24 responsive to the amount of toner remaining in the developer chamber 16.

In operation, when the image forming unit 100 is mounted to the apparatus body, it is ready to form an image on the paper S. At this instant, the shutter 15 is automatically opened to expose the drum 11 via the opening of the unit 100, so that the drum 11 faces the transfer roller 13.

A latent image is electrostatically formed on the drum 11 by the optics (dash-and-dot line, FIG. 3) and then developed by the toner deposited on the developing roller 17. Specifically, the toner is transferred from the developing roller 17 to the drum 11 by the bias applied to the roller 17 and the electrostatic attraction of the latent image.

A bias is applied to the conductive sheet member 21 adjoining the guide surface 100C of the image forming unit 100 in order to prevent the toner from depositing on the sheet member 21, as in the configuration shown in FIG. 2. This bias is apt to charge the paper S. However, the nonconductive sheet member 22 intervening between the conductive sheet member 21 and the paper S prevents the paper S from contacting the sheet member 21 although the paper S may contact the sheet member 22. This obviates charge transfer from the conductive sheet member 21 to the paper S.

We experimentally measured a current flowing through the discharge needle 23 under the same conditions as described with reference to FIG. 2. It was found that currents ranging from +3.5 $\mu$V to +6 $\mu$V flew through the discharge needle 23, but no currents of the same polarity as the bias for development flew. The paper S was therefore free from irregular charging. Further, the conventional irregularity in image density did not occur, i.e., the scattering of toner was minimized.

The toner image is transferred from the drum 11 to the paper S fed from a paper feeding device, not shown, by the transfer roller 13.

As stated above, the image forming unit 100 is made up of the drum block 100A including the drum 11 and the developing block 100B including the developing roller 17. The image forming unit 100 can therefore be bodily replaced if the constituents of the two blocks 100A and 100B and the cleaning blade 14 and charge roller 12 are provided with the same service life. This makes it needless to replace the various constituents one by one and thereby simplifies the management of the service life of parts including replacement. Consequently, the various members can be easily dealt with. Moreover, the positional accuracy between the two sheet members 21 and 22 and the developing roller 17 or between the developing roller 17 and the drum 11 are adjustable within the image forming unit 100. This kind of adjustment guarantees positional accuracy far more easily than adjustment effected in the image forming apparatus.

Figure 5:
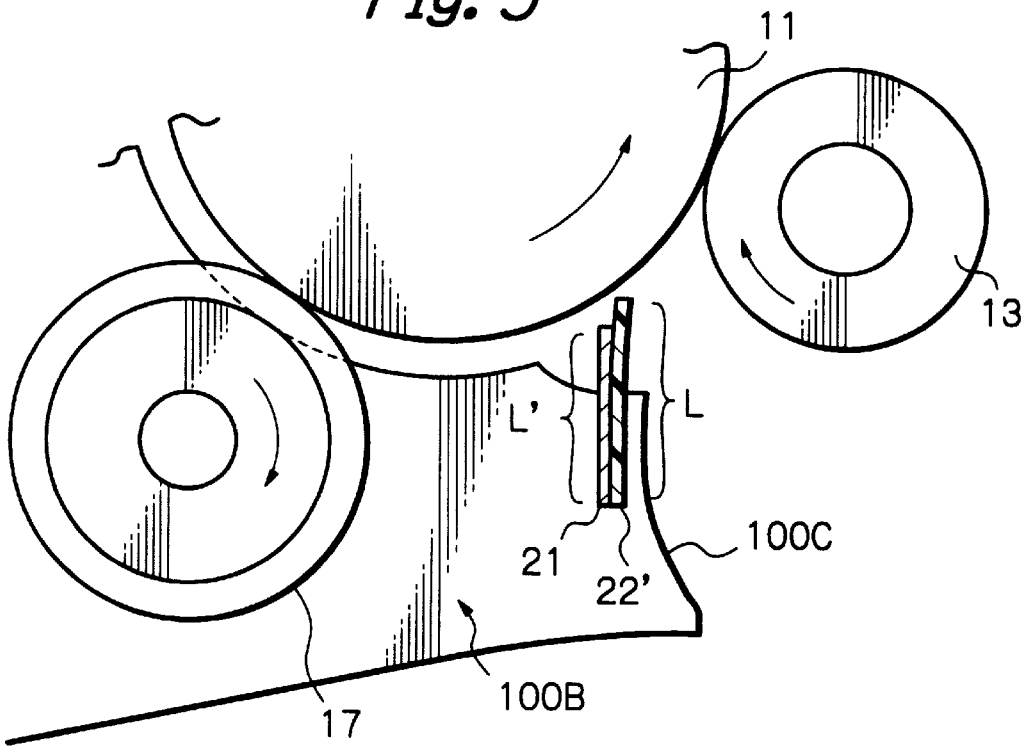
FIG. 5 is a view similar to FIG. 4, showing another specific configuration of the conductive sheet member and nonconductive sheet member.

FIG. 5 shows another specific configuration of the conductive sheet member 21 and nonconductive sheet member 22. As shown, a nonconductive sheet member 22' adhered to the previously mentioned surface of the conductive sheet member 21 has a length L greater than the length L' of the conductive sheet member 21. The lengths L and L' are measured from the lower ends of the sheet members 22 and 21 in the direction in which the paper S moves via the drum 11 and transfer roller 13. In this configuration, the upper end of the sheet member 22' protrudes above the upper end of the sheet member 21.

In the modification of FIG. 5, the nonconductive sheet member 22' covers the entire length of the conductive sheet member 22 in the direction of movement of the paper S. This, coupled with the fact that the sheet member 22' protrudes above the sheet member 21, surely prevents the paper S from contacting the sheet member 21 and thereby fully obviates charge transfer from the sheet member 21 to the paper S. Furthermore, an occurrence that a charge output from the edge of the sheet member 21 is input to the paper S via the sheet member 22' is obviated. The paper S is therefore entirely free from an irregular charge distribution. In addition, even when adhesive used to adhere the two sheet members 21 and 22 partly flows out via the edges of the sheet member 21, it is prevented from contacting and contaminating the paper S.

In summary, in accordance with the present invention, a nonconductive sheet member is affixed to the surface of a conductive sheet member which will face a paper and protects the paper from the influence of a bias applied to the conductive sheet member. The paper is therefore free form charges different in polarity from a transfer bias, so that toner is prevented from scattering toward the paper.

The nonconductive sheet member longer than the conductive sheet member fully obviates charge transfer from the conductive sheet member to the paper.

Further, an image carrier and a developing device are constructed into a single miniature image forming unit. If the constituents of the image forming unit are provided with the same service life, the image forming unit can be bodily replaced in order to save time, labor and cost for replacement. In addition, the image forming unit easily implements required positional accuracy between various members within an image forming apparatus.

Various modifications will become possible for those skilled in the art after receiving the teachings of the present disclosure without departing from the scope thereof.

What is claimed is:

1. An image forming apparatus comprising:

a conductive sheet member facing a developing roller which included in a developing device;

bias applying means for applying a bias of a same polarity as a bias for development to said conductive sheet member; and a nonconductive sheet member affixed to said conductive sheet member in such a manner as to face a recording medium prior to the recording medium carrying a toner image formed by said developing device.

2. An apparatus as claimed in claim 1, wherein said nonconductive sheet member has a greater length than said conductive sheet member, as measured in a direction in which the recording medium moves.

3. An apparatus as claimed in claim 2, wherein the bias applied to said conductive sheet member comprises a DC component and an AG component superposed on each other.

4. An image forming unit for an image forming apparatus, comprising:

an image carrier for forming a latent image thereon;

a developing device for developing the latent image;

a conductive sheet member facing a developing roller which is included in said developing device;

bias applying means for applying a bias of a same polarity as a bias for development to said conductive sheet member; and a nonconductive sheet member affixed to said conductive sheet member in such a manner as to face a recording medium prior to the recording medium carrying a toner image formed by said developing device.

5. A device for preventing a transfer of toner, comprising:

a developing roller included in a developing device;

a conductive member configured to receive a voltage having a same polarity as a voltage utilized for developing;

a transfer position at which an image defined by toner is transferred to a recording medium, the transfer position arranged such that the conductive member is disposed between the developing roller and at least one of the transfer position and a path of the recording medium; and a nonconductive member positioned between the conductive member and at least one of the transfer position and the path of the recording medium.

6. A device according to claim 5, wherein:

the nonconductive member is affixed to the conductive member.

7. A device according to claim 5, wherein:

the conductive member is a conductive sheet.

8. A device according to claim 5, wherein:

the nonconductive member is a nonconductive sheet.

9. A device according to claim 5, wherein:

the conductive member is disposed between the developing roller and the transfer position.

10. A device according to claim 5, wherein:

the conductive member is disposed between the developing roller and the path of the recording medium.

11. A device according to claim 5, wherein:

the nonconductive member is positioned between the conductive member and the transfer position.

12. A device according to claim 5, wherein:

the nonconductive member is positioned between the conductive member and the path of the recording medium.

13. A device according to claim 5, further comprising:

a device configured to apply to the conductive member the voltage having a same polarity as a voltage utilized for developing.

14. A device according to claim 13, wherein:

the device configured to apply to the conductive member applies a voltage having a DC component and an AC component.

15. A device according to claim 5, wherein:

the nonconductive member has a greater length, as measured in a direction in which the recording medium moves, than a length of the conductive member.

16. A device according to claim 5, wherein said device is an image forming apparatus.

17. A method of preventing toner contamination, comprising the steps of:

adhering toner to a developing roller in a developing region;

repulsing, utilizing a bias voltage at an intermediate region, toner from the developing region from flying towards a path of a recording medium; and insulating the recording medium from said bias voltage which performs said repulsing.

18. A method according to claim 17, wherein said step of repulsing comprises:

applying the bias voltage to a conductive member.

19. A method according to claim 18 wherein said step of repulsing comprises:

applying the bias voltage to a conductive sheet member.

20. A method according to claim 17, wherein said step of insulating comprises:

moving the recording medium along a path which has a nonconductive member disposed between a source of the repulsing and the path.

21. A method according to claim 20, wherein said step of insulating comprises:

moving the recording medium along a path proximate to the nonconductive member which is affixed to a conductive member.

* * * * *